US006650298B2

(12) United States Patent
Abbasi et al.

(10) Patent No.: US 6,650,298 B2
(45) Date of Patent: Nov. 18, 2003

(54) DUAL-BAND INTERNAL ANTENNA FOR DUAL-BAND COMMUNICATION DEVICE

(75) Inventors: Aamir Abbasi, Mundelein, IL (US); Michael Harshbarger, Lake Villa, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/034,869

(22) Filed: Dec. 27, 2001

(65) Prior Publication Data

US 2003/0122726 A1 Jul. 3, 2003

(51) Int. Cl.[7] ..... H01Q 1/38; H01Q 1/24

(52) U.S. Cl. ..... 343/702; 343/700 MS; 343/846

(58) Field of Search ..... 343/700 MS, 702, 343/846

(56) References Cited

U.S. PATENT DOCUMENTS 5,926,139 A * 7/1999 Korisch ..... 343/702
6,268,831 B1 * 7/2001 Sanford ..... 343/702
6,346,914 B1 * 2/2002 Annamaa ..... 343/700 MS
6,448,932 B1 * 9/2002 Stoiljkovic et al. .. 343/700 MS
6,456,250 B1 * 9/2002 Ying et al. ..... 343/702
6,476,769 B1 * 11/2002 Lehtola ..... 343/702
6,486,837 B2 * 11/2002 Spiegel et al. ..... 343/702
6,504,507 B2 * 1/2003 Geeraert ..... 343/700 MS
6,515,630 B2 * 2/2003 Honda ..... 343/702

* cited by examiner

*Primary Examiner*—Tan Ho
(74) *Attorney, Agent, or Firm*—Rowland K. Bowler, II

(57) ABSTRACT

A dual band internal antenna for a mobile wireless communication device, having a generally planar radiating element (100) with a high and low band portions, and ground and feed contacts (130, 140) extending from the radiating element. In one embodiment, the width of the ground contact is approximately twice the width of the feed contact. In another embodiment one or more radiating portions (150, 160) extend from the radiating element. In another embodiment, the low band portion has an arm (124) that extends about a tapered lobe (114) of the high band portion.

29 Claims, 3 Drawing Sheets

DUAL-BAND INTERNAL ANTENNA FOR DUAL-BAND COMMUNICATION DEVICE

FIELD OF THE INVENTIONS

The present inventions relate generally to internal multi-band antennas, and more particularly to dual-band internal antennas for dual-band communications devices and combinations thereof.

BACKGROUND OF THE INVENTIONS

As cellular telephone handsets continue to be reduced in size, consumers expect phones with either non-retractable antennas or internal antennas that are not at all visible. In general, retractable and stubby antennas work together with a ground plane provided the antenna is located away from the ground plane. When retractable and stubby antennas are located near the ground plane, the input impedance drops to very low values. Stubby antennas do not work well generally in close proximity of a ground plane.

Internal antennas are known generally as disclosed, for example, in U.S. Pat. No. 5,926,139 entitled "Planar Dual Frequency Band Antenna". More particularly, the dual frequency antenna of U.S. Pat. No. 5,926,139 includes a ground plane separated by a dielectric from a planar radiating element having first and second inverted F-antenna portions joined by an interconnecting portion, which is coupled by to the ground plane by a ground pin. A feed pin coupled to the radiating element extends through the ground plane by an insulating via.

The various aspects, features and advantages of the present invention will become more fully apparent to those having ordinary skill in the art upon careful consideration of the following Detailed Description of the Invention with the accompanying drawings described below.

DETAILED DESCRIPTION OF THE INVENTIONS

Figure 1:
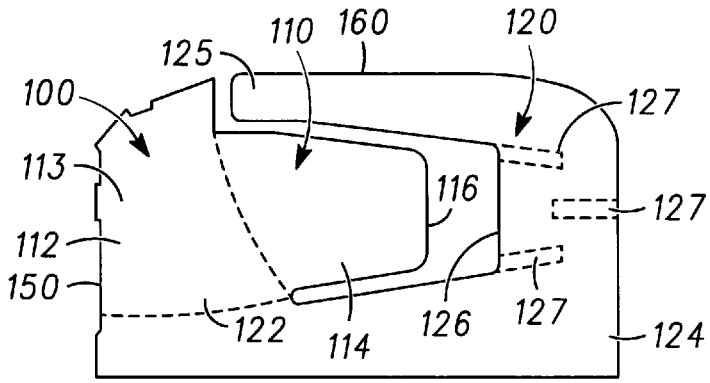
FIG. 1 is a top plan view of an exemplary radiating element portion of an internal dual band antenna.

In FIG. 1, an exemplary dual band internal antenna for a mobile wireless communication device comprises a radiating or resonator element 100 having a high band portion 110 and a low band portion 120. The exemplary resonator element is generally planar, with slight contours particularly near the outer portions thereof to accommodate housing contours, as discussed further below. In other embodiments, the generally planar radiating element may have more or less contour than in the exemplary embodiment. In the present application, a generally planar radiating element includes a planar radiating element without contours.

In FIG. 1, the exemplary high band portion includes a base 112 with a lobe 114 extending therefrom. The exemplary lobe 114 has a narrowing taper in a direction away from the base thereof. The tapering end portion of the lobe affects the impedance of the high band portion and thus the bandwidth of the antenna. In other embodiments, the lobe is not tapered. In FIG. 1, the low band portion includes a base 122 with an arm 124 extending therefrom.

The high band portion of the resonator element and the low band portion thereof are coupled generally by a portion of the resonator element. In the exemplary embodiment, the base 112 of the high band portion and the base 122 of the low band portion share a common base portion 113, which is the area demarcated in FIG. 1 by broken lines.

In the exemplary embodiment, the arm of the low band portion extends at least partially about, in spaced apart relation from, the lobe of the high band portion. The exemplary arm 124 of the low band portion is a generally U-shaped member extending about the lobe 114 in spaced apart relation therefrom. A distal end portion 125 of the arm of the low band member is disconnected from the lobe 114. In FIG. 1, the arm 124 extends about three sides of the lobe, and more particularly about opposite sides and about the distal end 116 of the lobe 114. The spacing, or coupling gap dimension, between the distal end 116 of the lobe and an adjacent portion 126 of the arm determines generally the bandwidth separation of the antenna and the high frequency tuning thereof.

In alternative embodiments, the high and low band portions of the resonator element may have other configurations, for example, the low band arm may not be disposed about the high band arm, and/or the low band arm may have a serpentine pattern, formed for example by providing gaps, illustrated by broken lines 127 in FIG. 1, to increase the electrical length of the low band portion.

The internal antenna also comprises generally a ground contact and a feed contact extending from the resonator element. In one embodiment, the width of the ground contact is approximately twice the width of the feed contact. In other embodiments, however, the width dimensions of the feed and ground contacts may differ in other proportions or be approximately the same. In the exemplary embodiment of FIGS. 2 and 3, the ground contact 130 and feed contact 140 both extend from the common base portion of the resonator element, generally perpendicular thereto. The exemplary ground contact 130 and feed contact 140 are both configured as bowed spring contact elements biased into engagement with corresponding contacts pads as discussed more fully below.

Figure 3:
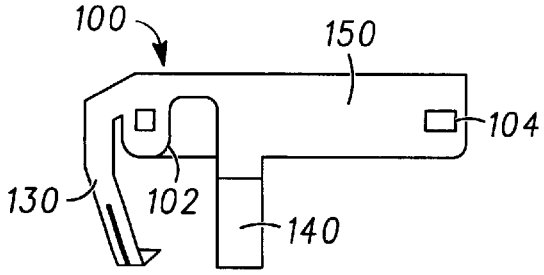
FIG. 3 is an end view of exemplary radiating element portion of an internal dual band antenna.

In one embodiment, the internal antenna includes one or more radiating elements extending from the resonator element in a different dimension than the plane of the generally planar resonator element. The one or more radiating portions generally increase the electrical length of one or both band portions of the resonator element, thus increasing the efficiency of the antenna. In FIGS. 1 and 3, a first radiating portion 150, or at least a portion thereof, extends generally perpendicularly from the portion of the generally planar radiating element, at the common base portion 113 in FIG. 1, interconnecting the high band portion and the low band portion. Thus configured, the radiating element 150 improves the bandwidth of both the high and low band portions of the resonator element. Additionally, the radiating portion adds capacitive coupling to the ground plane, thus improving bandwidth.

Figure 2:
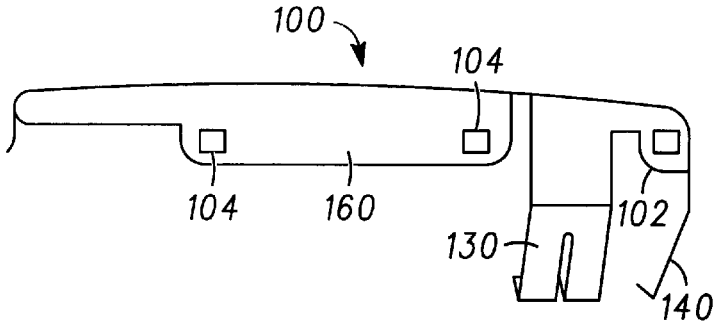
FIG. 2 is a side view of an exemplary radiating element portion of an internal dual band antenna.

In FIG. 2, a second radiating portion 160 extends generally perpendicularly from the low band portion of the generally planar radiating element. More particularly, the second radiating portion 160 extends generally perpendicularly from some portion of the arm 124 of the low band portion opposite the side thereof on which the lobe 114 is disposed. In FIG. 1, the second radiating element 160 extends from the end portion 125 of the arm 124. The exemplary second radiating portion 160 primarily increases the electrical length of the low band portion and further improves the bandwidth thereof.

Figure 4:
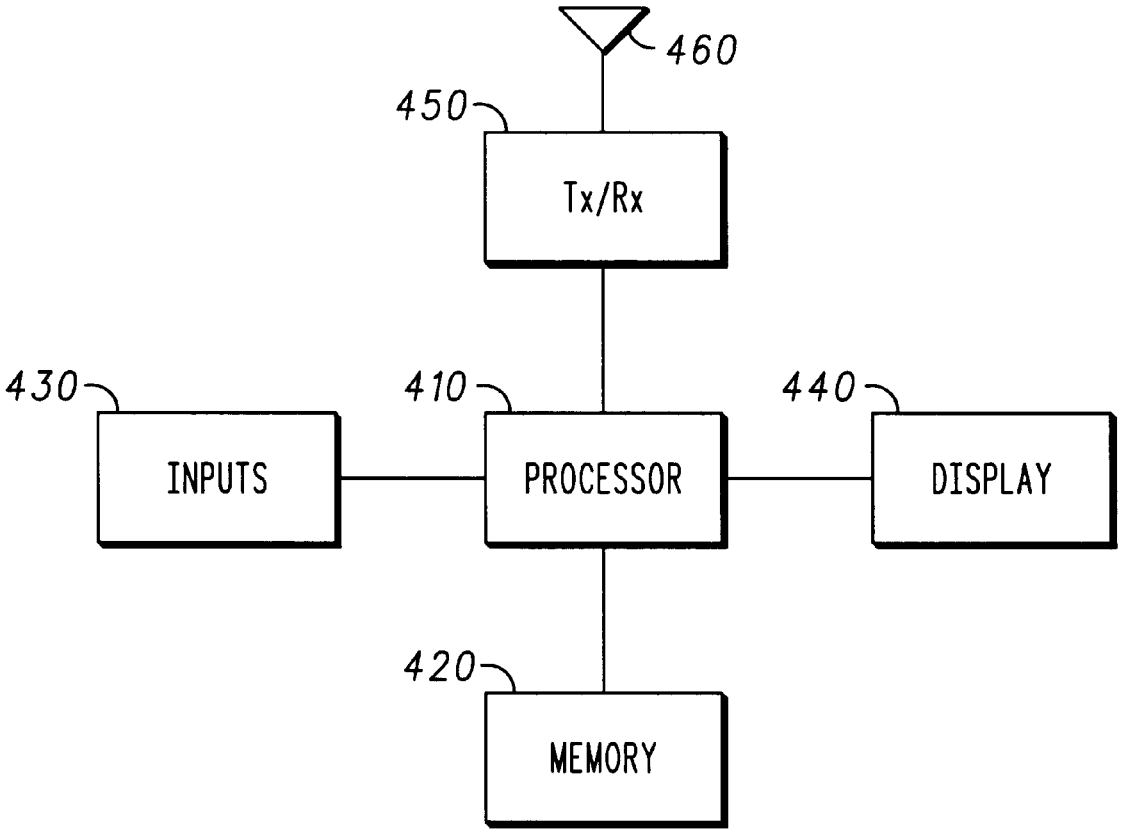
FIG. 4 is an electrical schematic for an exemplary dual band wireless mobile communications device.

FIG. 4 is an electrical schematic for a dual band wireless mobile communications device comprising generally a processor 410 coupled to memory 420, for example RAM and ROM, user inputs 430, for example an alpha and/or numeric keypad, a display 440 and a transceiver 450 coupled to an antenna 460, which includes an internal dual band antenna. The wireless mobile communications device is, for example, a cellular communications handset, or a corresponding portion of a wireless communication enable personal digital assistant (PDA), or a two-way pager or wireless enable laptop computer.

Figure 5:
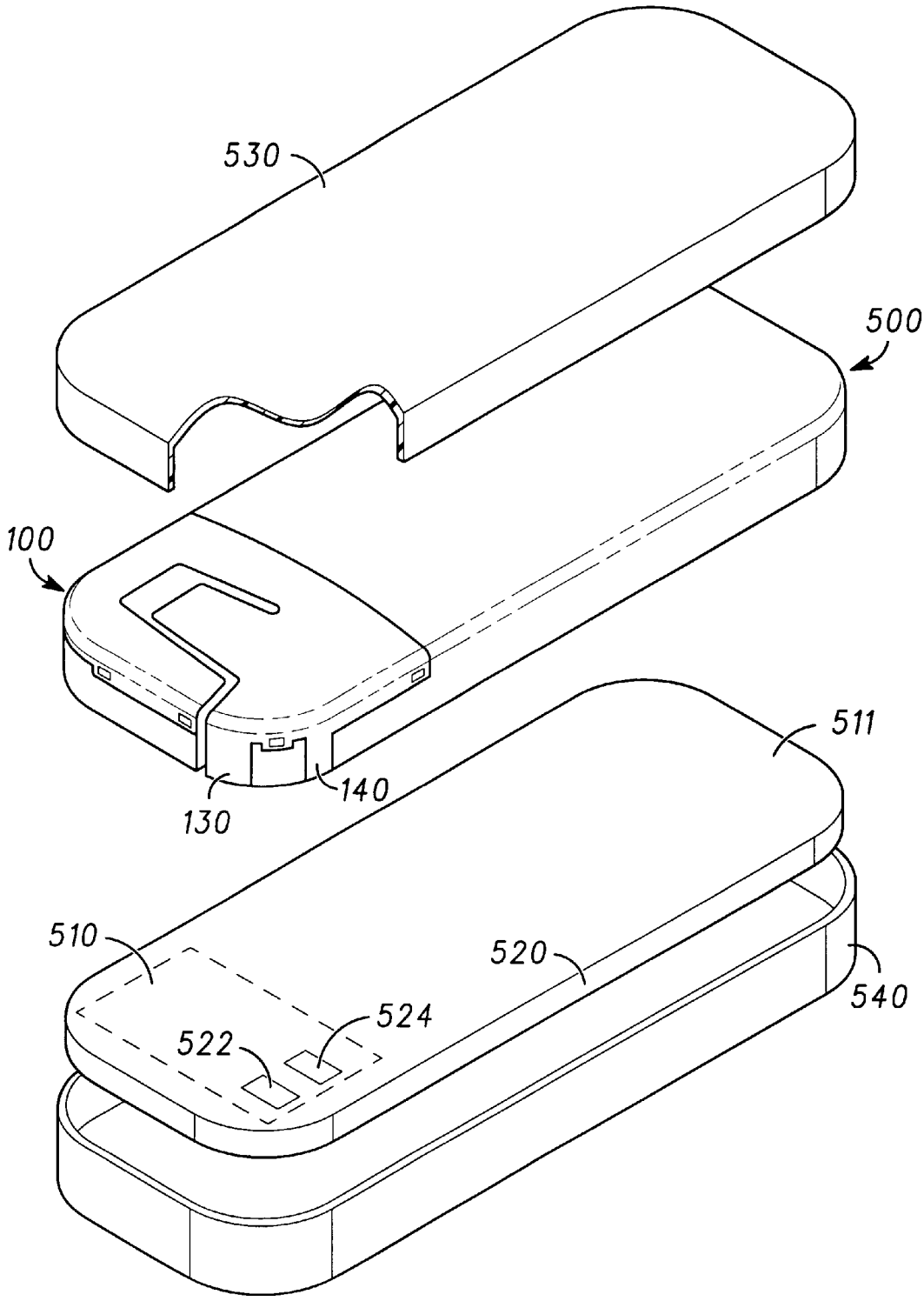
FIG. 5 is an expanded view of an exemplary housing portion for a communication handset.

In FIG. 5, the radiating element 100 is mounted on a non-conductive communications handset endo-housing 500 in spaced apart relation from a ground plane 510, which is disposed on a printed circuit board 520. The endo-housing may be mounted on the printed circuit board directly, or the endo-housing may be mounted on an outer housing portion, which is discussed further below.

In FIGS. 2 and 3, a plurality of fastening tabs 102 having apertures extend generally perpendicularly from the radiating member on the same side thereof as the ground and feed contacts. In the exemplary embodiment, some tabs are formed integrally with the first and second radiating portions, resulting in apertures 104 on the radiating portions. Other removable engagement configurations may be used besides tabs with apertures, for example clips.

In FIG. 5, the plurality of fastening tabs are engaged with corresponding portions of the endo-housing, thus retaining the radiating element on the endo-housing. In one embodiment, the resonator element is removably fastened to the endo-housing, for example with tabs or clips, and in another alternative embodiment the resonator element is permanently affixed thereto, for example by heat-staking, or by insert molding or by some other mounting means.

In the exemplary embodiment, electrical communications hardware, for example a processor, memory, transceiver and other elements mounted on the circuit board are housed by the endo-housing. In other embodiments, the endo-housing is at least large enough to accommodate the resonator element, thus leaving exposed other portions 511 of the circuit board. The endo-housing 500 and circuit board 520 are assembled and disposed in an outer handset housing comprising first and second cosmetic portions 530 and 540.

The exemplary ground plane 510 is disposed between layers of a multi-layer circuit board 520 and is coupled to an exposed electrical contact pad 522 that makes an electrical connection with the ground contact 130 of the radiating element 100. In other embodiments, the ground plane may be on an exposed surface of the circuit board wherein the ground contact pad is a portion of the ground plane. A feed contact pad 524 disposed on the printed circuit board and coupled to the communications hardware makes electrical contact with the feed contact 140 on the resonator element 100. The exemplary feed and ground contacts on the resonator element are both bowed spring contact elements spring biased into to electrical contact with the corresponding electrical contacts on the circuit board. The feed and ground contacts are preferably of the same material as the contact pads.

In one embodiment, the generally planar radiating element, the feed and ground contacts, and any radiating portions thereof constitute a unitary metal article, formed for example in a stamping operation, or by wire cutting or etching and subsequent forming operation, or some other mode of manufacture. In other embodiments, the resonator element and feed and ground contacts may be an assembly having discrete feed and ground pins fastened to the resonator element.

In one embodiment, the unitary radiating element is a Beryllium Copper material (C17200) with ¼ hardness, and in another embodiment the unitary radiating element is a Phosphorous Bronze material (C51000) with ½ hardness. Other materials having another hardness may be used alternatively, but generally there a trade-off between material hardness and the formability thereof. Thus the hardness is limited to some extent by the desired shape of the article.

In one embodiment, the radiating element, feed and ground contacts and any additional radiating portions are coated with Nickel plating and at least the pin portions are Gold plated. In some mode of production, these portions of the antenna are formed of a pre-plated material, thus eliminating the need for post plating operations. As noted, the contact pads of the circuit board are preferably of the same material as the feed and ground contacts with which they are mechanically engaged. In other modes of manufacture, the plating is performed after the forming operation.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

What is claimed is:

1. A dual band internal antenna for a mobile wireless communication device, comprising:

a generally planar radiating element having a high band portion and a low band portion, a ground contact extending from the generally planar radiating element;

a feed contact extending from the generally planar radiating element, the ground contact having a width approximately twice a width of the feed contact.

2. The dual band internal antenna of claim 1, the high band portion having a base with a lobe extending therefrom, the low band portion having a base with an arm extending therefrom, the base of the high band portion and the base of the low band portion sharing a common base portion, the ground contact and the feed contact both extending from the common base portion generally perpendicular to the generally planar radiating element.

3. The dual band antenna of claim 2, the ground contact and the feed contact are both bowed spring contact elements.

4. The dual band antenna of claim 2, the lobe of the high band portion has a narrowing taper in a direction away from the base thereof.

5. The dual band antenna of claim 1, the high band portion having a base with a lobe extending therefrom, the low band portion having a base with an arm extending therefrom, the arm of the low band portion extending at least partially about and spaced apart from the lobe of the high band portion, the ground contact and the feed contact extending generally perpendicularly from the generally planar radiating element.

6. The dual band antenna of claim 1, the generally planar radiating element is contoured.

7. The dual band antenna of claim 1, the generally planar radiating element and the feed and ground contacts thereof constitute a unitary metal article.

8. The dual band antenna element of claim 1, a first radiating portion extending generally perpendicularly from the generally planar radiating element on the same side thereof as the ground contact and feed contact.

9. The dual band antenna of claim 8, a second radiating portion extending generally perpendicularly from the generally planar radiating element.

10. A dual band internal antenna for a mobile wireless communication device, comprising:

a generally planar radiating element having a high band portion and a low band portion interconnected by a portion of the generally planar radiating element, a first radiating portion extending generally perpendicularly from the portion of the generally planar radiating element interconnecting the high band portion and the low band portion;

a ground contact and a feed contact both extending from the generally planar radiating element on the same side thereof as the first radiating portion.

11. The dual band antenna of claim 10, a second radiating portion extending generally perpendicularly from the low band portion of the generally planar radiating element.

12. The dual band antenna of claim 10, the high band portion having a base with a lobe extending therefrom, the low band portion having a base with an arm extending therefrom, a common base portion shared by the base of the band portion and the base of the low band portion, at least a portion of the first radiating portion extending generally perpendicularly from the common base portion.

13. The dual band antenna of claim 12, the ground contact and the feed contact are both bowed spring contacts extending generally perpendicularly from the generally planar radiating element.

14. The dual band internal antenna of claim 12, the ground contact having a width approximately twice a width of the feed contact.

15. A dual band internal antenna of claim 12, the arm of the low band portion disposed at least partially about and spaced apart from the lobe of the high band portion, a second radiating portion extending generally perpendicularly from the arm of the low band portion on the same side of the generally planar radiating element as the ground and feed contacts.

16. The dual band internal antenna of claim 15, the generally planar radiating element, the feed and ground contacts, and the first and second radiating portions thereof constitute a unitary metal article.

17. The dual band internal antenna of claim 15, the lobe having opposite side portions and an end portion, the base of the low band portion extending from one side of the lobe, the arm of the low band portion disposed about and spaced apart from the opposite sides of the lobe and the end portion thereof, the second radiating portion extending generally perpendicularly from the arm of the low band portion opposite the side thereof on which the lobe is disposed.

18. The dual band internal antenna of claim 10, a plurality of fastening tabs extending generally perpendicularly from the generally planar radiating member on the same side thereof as the ground and feed contacts.

19. The dual band internal antenna of claim 10, the arm of the low band portion is a generally U-shaped member extending about in spaced apart relation from the lobe of the high band portion, a distal end of the arm of the low band member disconnected from the lobe, the second radiating portion extending from a side of the arm of the low band portion opposite a side thereof adjacent the lobe.

20. A dual-band mobile wireless communication device, comprising:

a non-conductive endo-housing;

a radio transceiver coupled to a controller;

user inputs and user outputs coupled to the controller;

a dual band internal antenna disposed in the housing and coupled to the transceiver, the dual band internal antenna having a ground plane and a generally planar radiating element, the generally planar radiating element having a high band portion and a low band portion, the high band portion and the low band portion interconnected by a portion of the generally planar radiating element, at least a portion of a first radiating portion extending generally perpendicularly from the portion of the generally planar radiating element interconnecting the high band portion and the low band portion, the generally planar radiating element disposed on the endo-housing in spaced apart relation to the ground plane;

a ground contact extending from the generally planar radiating element in electrical contact with the ground plane;

a feed contact extending from the generally planar radiating element, the feed contact coupled to the transceiver.

21. The dual band mobile wireless communication device of claim 20, the ground contact having a width approximately twice a width of the feed contact.

22. The dual-band mobile wireless communication device of claim 20, the high band portion having a base with a lobe extending therefrom, the low band portion having a base with an arm extending therefrom, the base of the high band portion and the base of the low band portion sharing a common base portion, the ground contact and the feed contact both extending from the common base portion generally perpendicular to the generally planar radiating element.

23. The dual-band mobile wireless communication device of claim 20, a second radiating portion extending generally perpendicularly from the low band portion of the generally planar radiating element.

24. The dual-band mobile wireless communication device of claim 20, the ground contact and the feed contact are both bowed spring contacts extending generally perpendicularly from the generally planar radiating element, the ground contact is spring biased against a ground contact pad of the ground plane.

25. The dual-band mobile wireless communication device of claim 20, a plurality of fastening tabs extending from the generally planar radiating member, the fastening tabs matably engaged with the endo-housing.

26. The dual-band mobile wireless communication device of claim 20, the ground plane is disposed on a printed circuit board, the endo-housing disposed between the printed circuit board and the generally planar radiating element, the endo-housing and the printed circuit board disposed in an outer housing.

27. The dual-band mobile wireless communication device of claim 26, the printed circuit board having a ground contact pad and a feed contact pad thereon, the feed contact of the generally planar radiating element electrically coupled to the feed contact pad, and the ground contact of the generally planar radiating element electrically coupled to the ground contact pad.

28. The dual-band mobile wireless communication device of claim 20, the high band portion having a base with a lobe extending therefrom, the low band portion having a base with an arm extending therefrom, the arm of the low band portion extending at least partially about, in spaced apart relation from, opposite sides and an end of the lobe of the high band portion.

29. The dual-band mobile wireless communication device of claim 20, the lobe of the high band portion has a narrowing taper in a direction away from the base thereof.

* * * * *